US006625914B1

(12) United States Patent
Sud

(10) Patent No.: US 6,625,914 B1
(45) Date of Patent: Sep. 30, 2003

(54) THREE-DIMENSIONAL DECORATION WITH RAISED IMAGE AND FILLER

(76) Inventor: Alexander M. Sud, 3704 Sudbury La., Louisville, KY (US) 40220

( * ) Notice: Subject to any disclaimer, the term of this patent is extended or adjusted under 35 U.S.C. 154(b) by 0 days.

(21) Appl. No.: 10/133,017

(22) Filed: Apr. 26, 2002

Related U.S. Application Data

(63) Continuation-in-part of application No. 09/951,172, filed on Sep. 13, 2001.
(60) Provisional application No. 60/233,182, filed on Sep. 15, 2000.

(51) Int. Cl.[7] ..... A47G 1/06
(52) U.S. Cl. ..... 40/743; 40/800
(58) Field of Search ..... 428/913.3, 14, 428/172; 40/738, 743, 781, 800, 124.07, 124.191

(56) References Cited

U.S. PATENT DOCUMENTS

| | | | | |
|---|---|---|---|---|
| 2,183,426 A | | 12/1939 | Hart | |
| 2,538,085 A | | 1/1951 | Cotton | |
| 2,631,046 A | | 3/1953 | Stephens | |
| 2,889,651 A | | 6/1959 | Baldanza | |
| 2,946,137 A | | 7/1960 | Worth et al. | |
| 3,310,321 A | | 3/1967 | Freund | |
| 3,321,860 A | | 5/1967 | Dichtl et al. | |
| 3,758,358 A | * | 9/1973 | Kuroda | 40/800 X |
| 3,798,806 A | | 3/1974 | Sanford | |
| 3,972,417 A | | 8/1976 | Iten et al. | |
| 4,161,090 A | * | 7/1979 | Watts, Jr. | |
| 4,215,499 A | | 8/1980 | Wilson | |
| 4,380,128 A | | 4/1983 | Ichikawa | 40/124.09 |
| 4,477,243 A | | 10/1984 | Wallsten | |
| 4,579,708 A | | 4/1986 | Rosart | |
| 4,737,329 A | | 4/1988 | Rakoczy | |
| 4,779,734 A | | 10/1988 | Kydonieus | |
| 4,840,275 A | | 6/1989 | Faiola et al. | 206/423 |
| 4,841,651 A | | 6/1989 | Conner | |
| 4,848,015 A | * | 7/1989 | Allen | |
| 4,883,692 A | * | 11/1989 | Spector | |
| 4,951,404 A | | 8/1990 | Lithwick | 229/92.8 X |
| 4,979,619 A | | 12/1990 | Hager | |
| 5,001,853 A | | 3/1991 | Odien | 40/312 |
| 5,119,574 A | | 6/1992 | King | 40/537 |
| 5,181,745 A | | 1/1993 | Jacobsen et al. | |
| 5,199,745 A | | 4/1993 | Balsamo | |
| 5,201,548 A | | 4/1993 | Lang et al. | 283/2 |
| 5,217,162 A | | 6/1993 | Shibahara | 229/92.8 |
| 5,345,705 A | * | 9/1994 | Lawrence | 40/800 X |
| 5,377,836 A | | 1/1995 | Eisenbraun | |
| 5,379,886 A | | 1/1995 | Brauner et al. | |
| 5,600,939 A | | 2/1997 | Giovannone | |
| 5,879,028 A | | 3/1999 | Benoit | |
| 6,106,023 A | | 8/2000 | Sud et al. | 283/117 |

* cited by examiner

*Primary Examiner*—Joanne Silbermann

(57) ABSTRACT

A decoration includes a thin cover sheet onto which an image has been printed and which has been formed into a contoured shape at least partially corresponding to the image. A filler support layer is added to the hollow side of the cover sheet and hardens.

14 Claims, 3 Drawing Sheets

THREE-DIMENSIONAL DECORATION WITH RAISED IMAGE AND FILLER

BACKGROUND OF THE INVENTION

This application is a Continuation-In-Part of U.S. application Ser. No. 09/951,172, filed Sep. 13, 2001, and claims priority from U.S. Provisional Application Ser. No. 60/233,182, filed Sep. 15, 2000, which are hereby incorporated by reference.

Relief images are well-known and have been made of clay, wood, plastic and other materials. A typical relief image is either cast or carved, and, if it includes a variety of colors, they usually are painted on by hand. One way to make an attractive relief image is to run a relatively thin plastic material through a printing device to create a high quality printed image and then to vacuum form the material to give relief to the image. However, in order to run the material through a printer, it must be relatively thin. This results in a fairly lightweight, flexible product, which does not have the same aesthetic appeal as a more solid cast or carved image. As shown in my U.S. Pat. No. 6,106,023, which is hereby incorporated by reference, one way to-protect the flexible image from being damaged is to provide a cover and a raised frame around the image. However, since the image is on a lightweight, flexible sheet, it can easily flex, and it does not have the same effect as a solid or cast piece. Similarly, as one picks up the image, the relative lack of weight gives away the fact that this is not a solid or cast piece. The more rigid the relief image is and the heavier it feels, the more it resembles a cast, carved, or solid piece, and the higher its perceived quality and value by the end user.

SUMMARY OF THE INVENTION

The present invention provides a plaque, wall hanging, or other decoration in which the hollow side of a thin, printed and formed member is filled with a filler, which hardens, thereby imparting structural strength. The filler may fill the hollow side of the member by any number of means, including casting, pouring, or injection molding. In the preferred embodiment, the filler is poured into the hollow side of the formed member. As the filler solidifies, the thin, printed and formed member preferably bonds with the filler to make a solid three-dimensional piece. This piece may be mounted to a frame, such a solid wooden frame, a frame may be part of the piece itself, or the piece may be unframed. The result is a heavy duty, attractive decoration having a raised, printed image. The decoration may be further personalized by attaching an engraved, brass tag or a label, or by other known means.

DESCRIPTION OF THE PREFERRED EMBODIMENT

Figure 1:
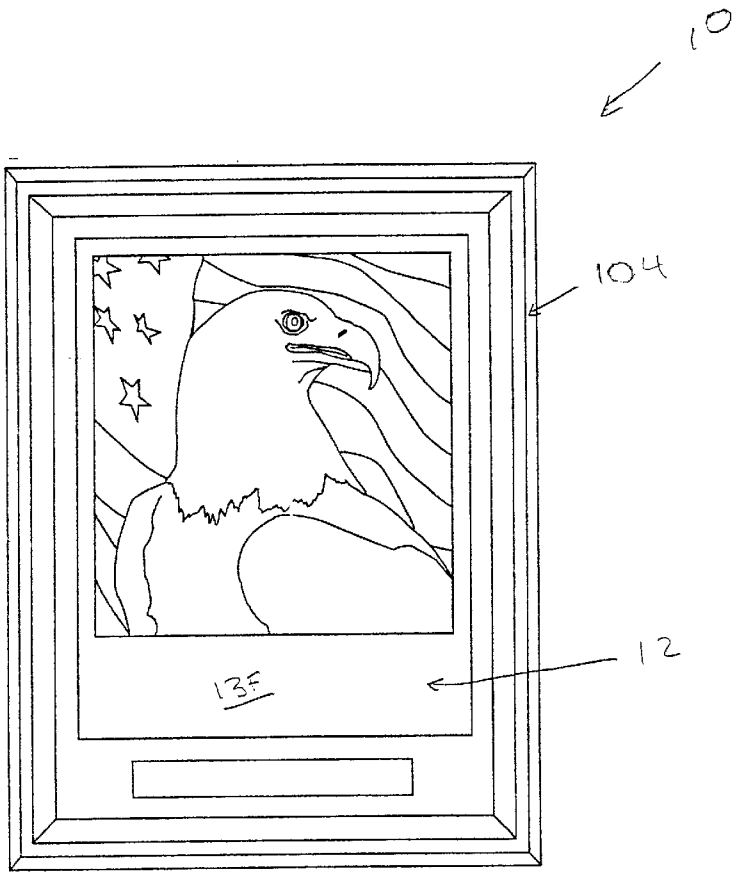
FIG. 1 is a front view of a raised image plaque made in accordance with the present invention.
Figure 2:
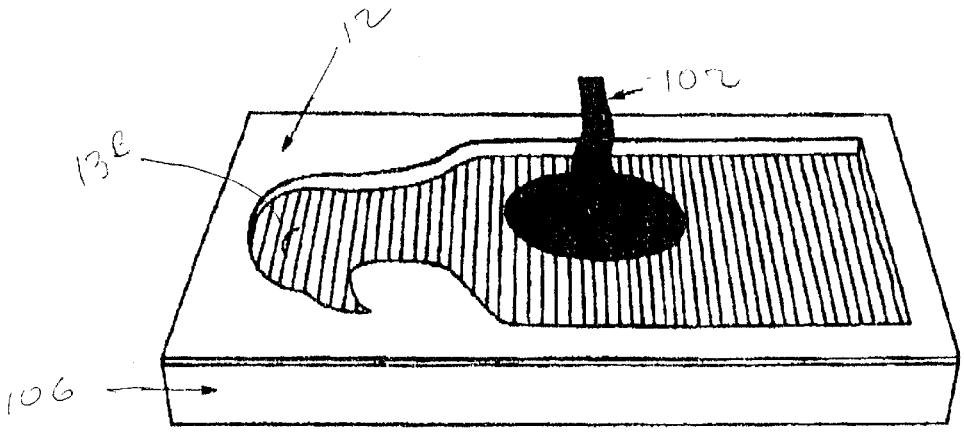
FIG. 2 is a perspective view of the back side of the raised image portion of the plaque of FIG. 1, resting on a support member and being filled with a filler.
Figure 3:
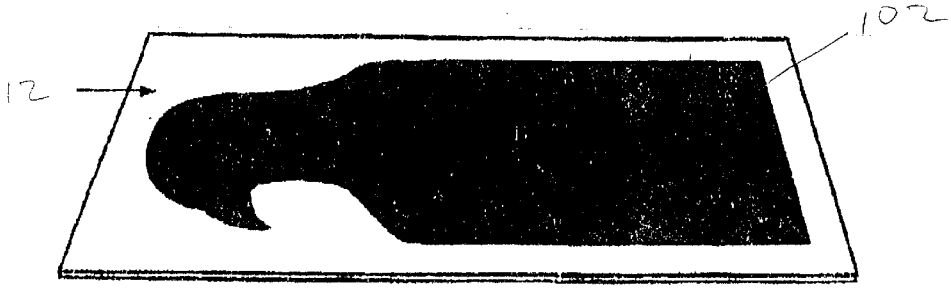
FIG. 3 is a perspective view of the raised image portion of the plaque of FIG. 2 after it has been filled.

FIGS. 1–5 show an example of a raised, three-dimensional decorative plaque 10 made in accordance with the present invention. As shown in FIGS. 1 and 3, this particular embodiment 10 comprises three pieces: a pre-printed, vacuum-formed cover sheet 12; a filler 102; and a frame 104. In this embodiment, the cover sheet 12 is formed by vacuum forming, and the frame 104 is injection molded.

The cover sheet 12 is printed and is then vacuum formed with contours corresponding to the image. The outside or front surface 13F is substantially convex, and the inside or back surface 13B is substantially concave (See FIGS. 2 and 5). In this preferred embodiment, the cover sheet 12 is made of 0.20-inch thick styrene. The printing preferably is done on a machine in which the printed, precut sheet 12 is fed through the printer. It may be desired to print a marble design or another type of attractive design in the frame area 20 of the printed sheet 12 and to print an image to be formed as a relief image in the central area 22. The cover sheet 12 is then vacuum formed or formed by another known method to provide a formed, relief image 24 in the central area 22. The formed cover sheet includes contours corresponding to the printed image. The forming process also forms rearwardly-directed edges 26 around the periphery, which terminate in a flange or lip 28 which flares out approximately perpendicular to the rearwardly-directed edges 26. A raised frame 20 may also be formed on the cover sheet 12 between the rearwardly-directed edges 26 and the formed, raised image 24. The depth of the raised image portion (in this embodiment the image is an eagle) is typically on the order of approximately one-eighth to one-half inch, and preferably about one-fourth of an inch. The depth of the cover sheet from the flange 28 to the most raised portion of the image is typically on the order of approximately one inch. Each portion of the cover sheet 12 may be printed differently, as desired, to produce an attractive product. For example, the central area 22 may be printed with a portrait or a landscape image (such as the eagle in this example), and the frame portion 20 may be printed with a marbelized design. While this preferred embodiment shows a rectangular-shaped cover sheet 12, it is understood that the plaque can be made in a variety of shapes, such as oval, hexagonal, circular, and so forth.

A support layer 106 (See FIG. 2) is used to support the thin, formed sheet 12 as it is being filled with a filler. The support layer 106 preferably is made of thicker material and is formed in substantially the same shape as the printed and formed cover sheet 12. This support layer 106 is typically a rubber support matting, though it may be any other type of support material, such as compacted sand, for instance. The printed and formed cover sheet 12 rests face-down on, and is supported by, the support layer 106 such that the convex front, printed surface 13F of the raised image 12 lies against the support layer 106, and the concave rear surface 13B of the raised image 12 (which is the hollow or concave surface of the raised image 12) is facing up.

A filler material 102 is then added to the substantially concave rear surface 13B of the image, preferably until the entire rear surface area 13B is filled. In other embodiments of this invention, it may be desirable to allow the filler 102 to overflow beyond the hollow surface 13B of the raised image 12, and allow the filler to reach the rearwardly directed edges 26 (See FIG. 5). In fact, it may be desirable to fill the entire rear surface of the raised image 12 until the filler is even with the flanges 28. The more filler added, the heavier the final piece will be.

The flanges 28 help to prevent the filler 102 from getting between the piece 12 and the support layer. Once the filler 102 has cured and solidified, the piece 12 is removed from the support layer 106, and any excess material such as the flanges 28 and parts of the rearwardly directed edges 26 may be trimmed so as to obtain a substantially smooth and flat back surface of the raised image 12, as shown in FIG. 3.

Figure 4:
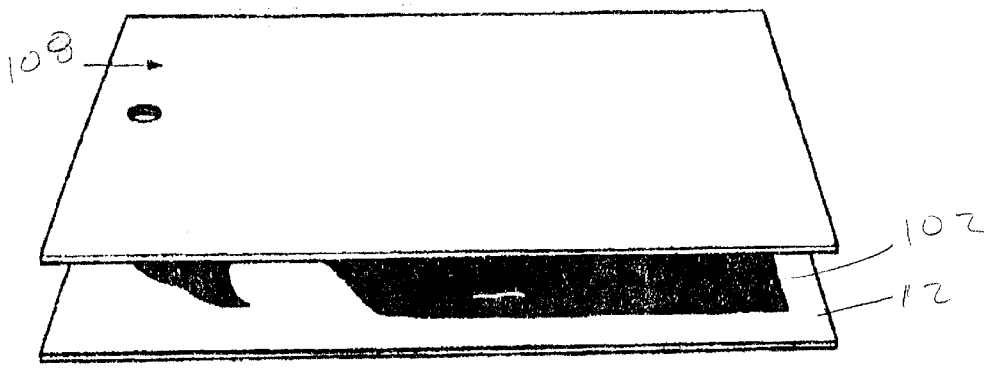
FIG. 4 is an exploded, perspective view of the filled, raised image portion of the plaque of FIG. 3 with a backer portion added.
Figure 5:
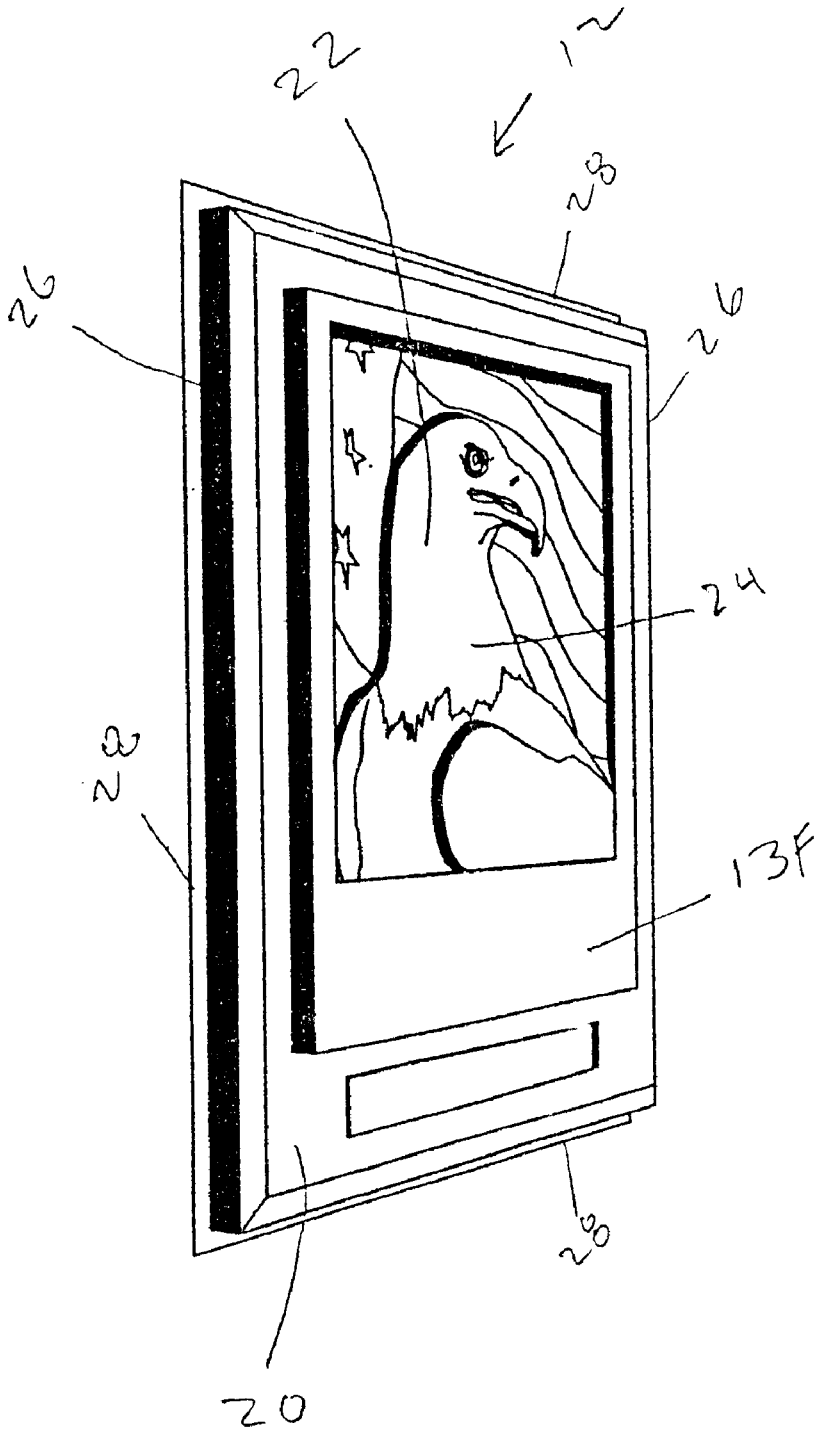
FIG. 5 is a perspective view of the raised image portion of the plaque of FIG. 1.
Figure 1:
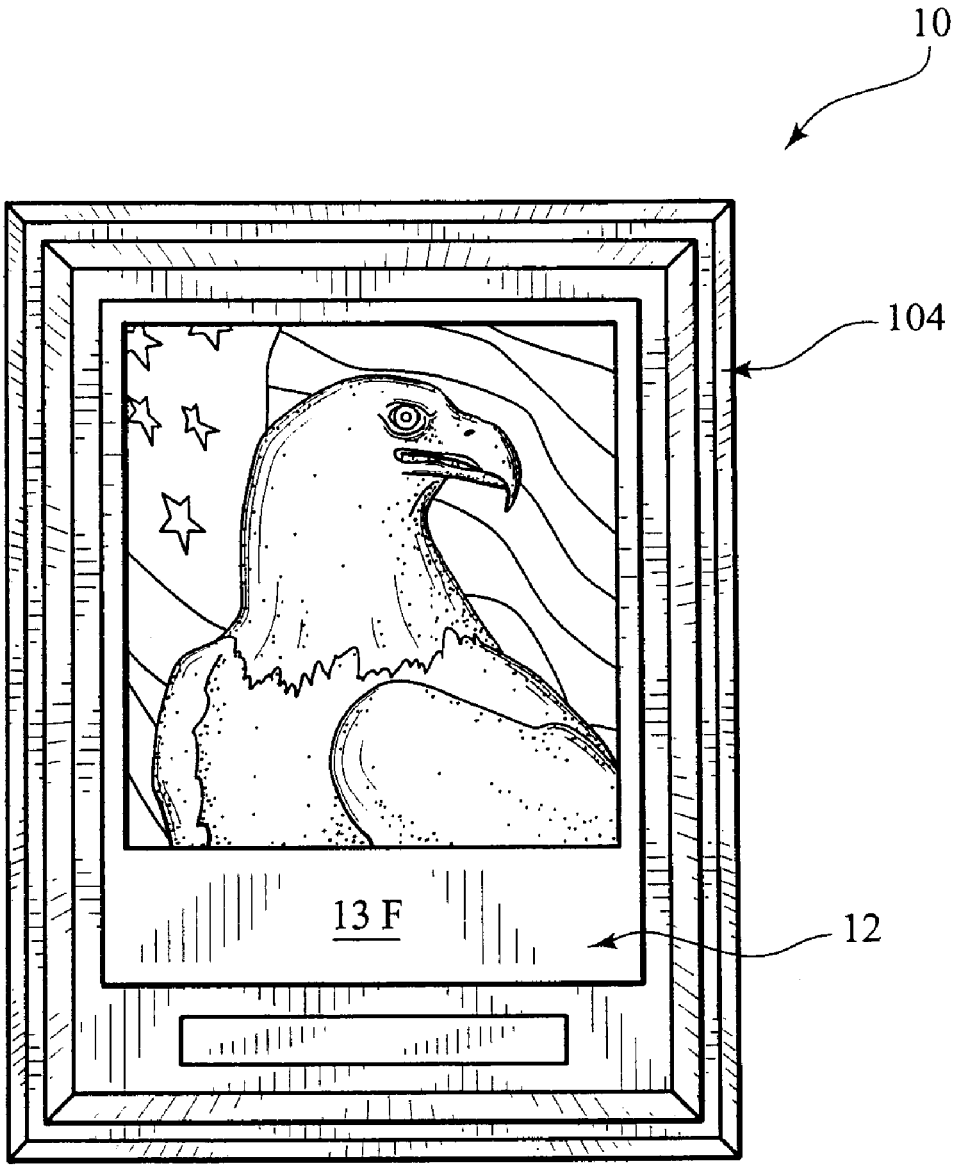
Figure 2:
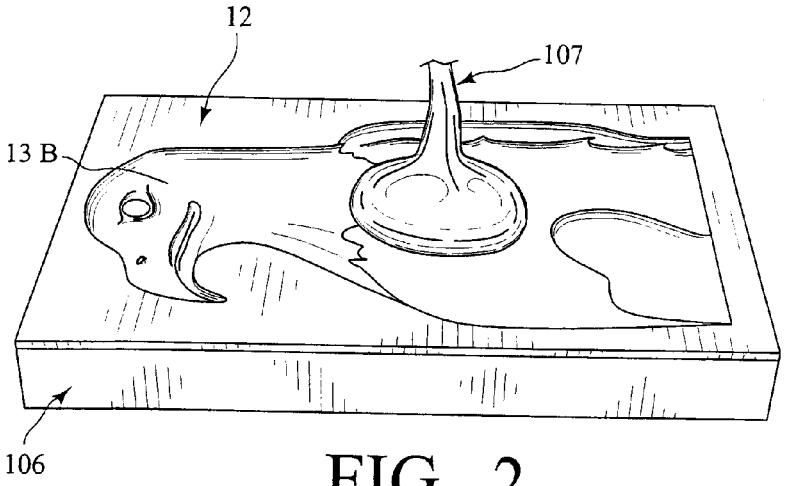
Figure 3:
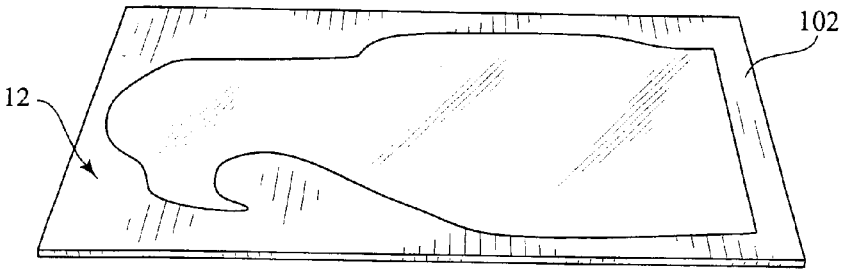
Figure 4:
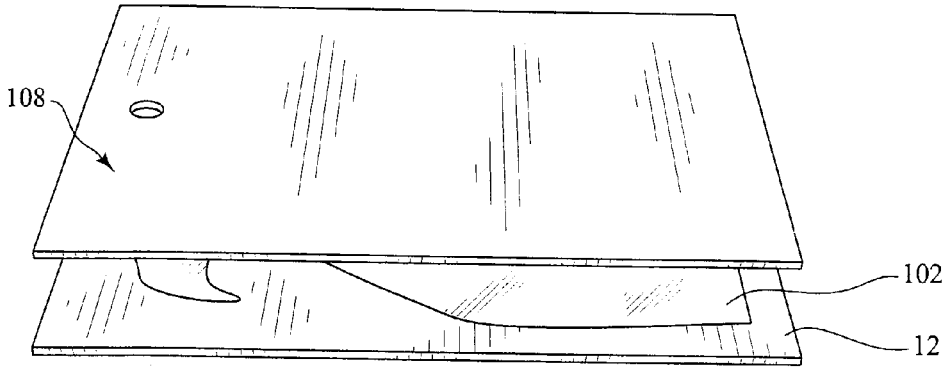
Figure 5:
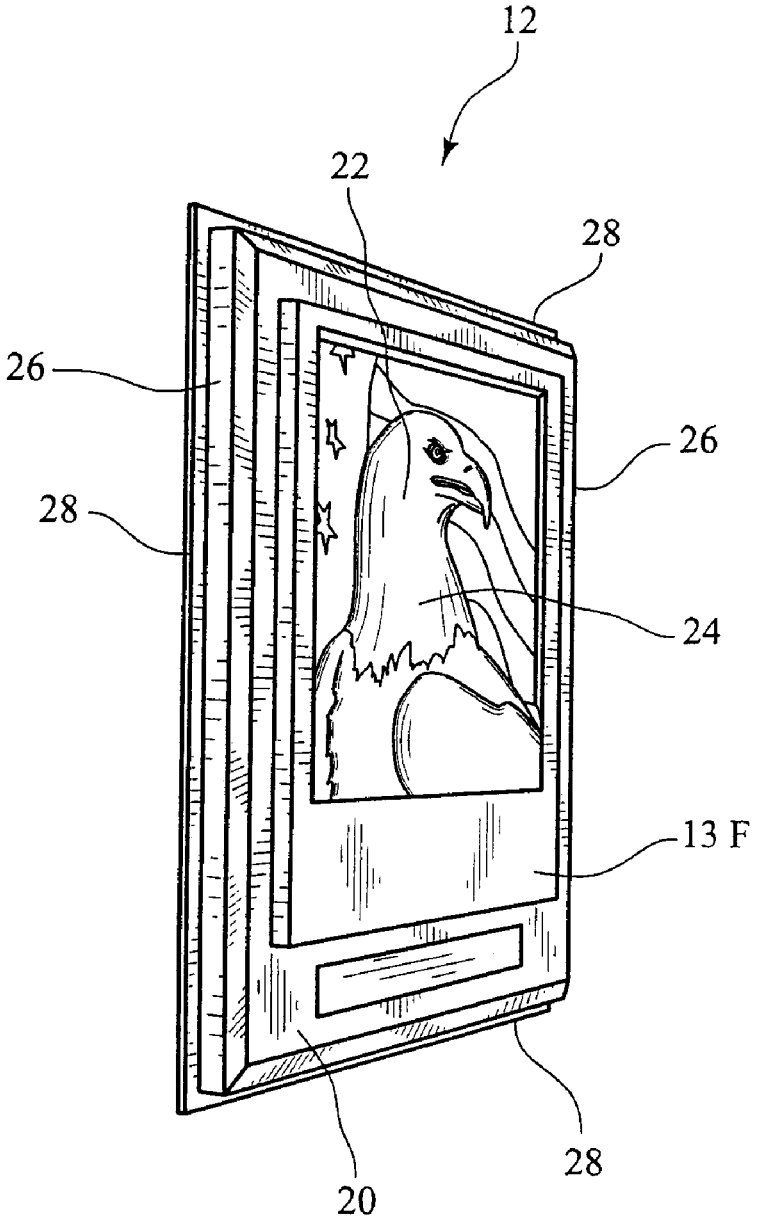

A backing member 108 of relatively flat material is secured to the back of the raised printed image 12, as shown in FIG. 4. Alternately, the raised printed image 12 shown in FIG. 3 may be secured (with an adhesive, for instance) to a separate frame 104 as seen in FIG. 1. Finally, it may be that neither a backing member 108 nor a separate frame 104 is desirable or required.

The filler 102 is preferably a polyurethane resin or a white gypsum cement such as Hydrocal (Hydrocal is a registered trademark product of United Sates Gypsum of 125 South Franklin, Chicago, Ill. 60606-4678). Once the filler hardens, it provides rigidity to the product, since it is much more rigid than the cover sheet 12. The filler 102 does not require high temperature curing (such as curing in an oven), which would tend to damage the raised printed image 12. Instead, the filler 102 hardens at room temperature. However, the hardening process of the filler may result in an exothermic reaction, and this temperature rise may cause slight melting or dissolving of the material from which the raise printed image 12 is made (which, as disclosed earlier is preferably a relatively thin styrene). This results in a good bond between the filler 102 and the raised printed image 12 over substantially the entire front surface area of the filler. However, this bond is not a requirement. Should the filler 102 and the raised printed image 12 not form a good bond during the hardening process of the filler 102, and should such a bond be deemed desirable, the corresponding front surface of the hardened filler 102 and rear surface of the raised image 12 may be secured to each other via an adhesive, for instance.

The significance of the support layer 106 is now evident. If the filler slightly dissolves or slightly melts the inside surface 13B of the relatively thin raised printed image 12, and this raised printed image 12 is not properly supported, the image 12 may warp, damaging the end product. The support layer 106 provides support to prevent warping of the printed image 12 while the filler is being added and is curing.

It will be obvious to those skilled in the art that modifications may be made to the embodiment described above without departing from the scope of the present invention.

What is claimed is:

1. A decoration, comprising;

a cover sheet having a substantially convex front face and a substantially concave rear face, including a printed image on said front face, wherein said cover sheet is raised and is formed into contours of varying depths, including contours corresponding to the printed image, said cover sheet being made of thin gauge material which can be run through a printer before forming; and a solid filler which fills said substantially concave rear face of said cover and is substantially more rigid than the cover, said filler having a front face including a contour which substantially corresponds to the contour of the cover sheet and having a rear face; wherein said filler has a front surface adjacent to the rear face of the cover sheet, and said front surface of said filler is bonded to said adjacent rear face of the cover sheet.

2. A decoration as recited in claim 1, wherein said filler comprises a polymer.

3. A decoration as recited in claim 1, wherein said filler comprises polyurethane resin.

4. A decoration as recited in claim 1, wherein said filler comprises gypsum.

5. A decoration as recited in claim 1, and further comprising a backing member enclosing the rear face of said filler.

6. A decoration, comprising;

a raised contour cover sheet defining a substantially convex front surface and a substantially concave back surface, including a printed image on said raised contour cover sheet, said raised contour cover sheet having varying depths including contours corresponding to the image; and having a thickness;

a support layer lying behind and supporting said cover sheet, said support layer defining a front surface and a back surface, wherein the front surface of said support layer substantially follows the contours of said substantially concave back surface and is bonded to said cover sheet over the majority of the front surface of said support layer.

7. A decoration as recited in claim 6, wherein said support layer comprises a polymer.

8. A decoration as recited in claim 7, wherein said support layer comprises polyurethane resin.

9. A decoration as recited in claim 6, wherein said support layer comprises gypsum cement.

10. A decoration as recited in claim 6, wherein the front face of said cover sheet includes a printed image.

11. A decoration as recited in claim 10, wherein said raised contour of said cover sheet is made by vacuum forming a flat sheet so that the rear face of the cover sheet has substantially the same contour as the front face.

12. A decoration as recited in claim 6, wherein said support layer is substantially solid and is substantially more rigid than said cover sheet, thereby forming a solid three-dimensional piece which gives the impression of a cast or carved image.

13. A decoration as recited in claim 12, wherein said support layer is made of a material that cures from a liquid to a solid at room temperature, without requiring the addition of outside heat.

14. A decoration, comprising:

a cover sheet, made of a thin gauge plastic material, having a substantially convex front face and a substantially concave rear face, including a printed image on said front face, wherein said cover sheet is raised and is formed into contours of varying depths, including contours corresponding to the printed image; and a solid filler which fills said substantially concave rear face of said cover sheet, following the contours of said cover sheet, said filler having a front surface and being bonded to said cover sheet along the majority of its front surface, thereby forming a solid, three-dimensional piece having at least the same rigidity as a solid wooden image.

* * * * *

UNITED STATES PATENT AND TRADEMARK OFFICE

CERTIFICATE OF CORRECTION

PATENT NO. : 6,625,914 B1 
DATED : September 30, 2003
INVENTOR(S) : Alexander M. Sud It is certified that error appears in the above-identified patent and that said Letters Patent is hereby corrected as shown below:

Delete Figures 1-5 and insert therefor the attached Figures 1-5.

Signed and Sealed this

Twenty-fourth Day of August, 2004

JON W. DUDAS
*Director of the United States Patent and Trademark Office*